US005970287A

United States Patent [19]

Yamaguchi

[11] Patent Number: 5,970,287

[45] Date of Patent: Oct. 19, 1999

[54] CHARGING DEVICE FOR CHARGING CHARGED BODY IN NON-CONTACT STATE

[75] Inventor: Chiseki Yamaguchi, Niigata, Japan

[73] Assignee: NEC Corporation, Tokyo, Japan

[21] Appl. No.: 09/064,501

[22] Filed: Apr. 23, 1998

[30] Foreign Application Priority Data

Apr. 23, 1997 [JP] Japan ..... 9-105475

[51] Int. Cl.[6] ..... G03G 15/02

[52] U.S. Cl. ..... 399/168; 250/325; 399/170; 430/35

[58] Field of Search ..... 399/50, 168, 170; 430/35; 250/324–326; 361/220

[56] References Cited

U.S. PATENT DOCUMENTS

| | | | |
|---|---|---|---|
| 5,293,200 | 3/1994 | Tsusaka . | |
| 5,360,940 | 11/1994 | Hays | 399/270 |
| 5,515,142 | 5/1996 | Rommelmann | 399/285 |
| 5,517,287 | 5/1996 | Rodriguez et al. | 399/285 |
| 5,539,501 | 7/1996 | Yu et al. | 399/171 |
| 5,594,534 | 1/1997 | Genovese | 399/285 |

FOREIGN PATENT DOCUMENTS

| | | |
|---|---|---|
| 0 652 491 A2 | 10/1995 | European Pat. Off. . |
| 61-99172 | 5/1986 | Japan . |
| 6-161218 | 7/1994 | Japan . |
| 6-194932 | 7/1994 | Japan . |
| 8-106198 | 4/1996 | Japan . |

*Primary Examiner*—Matthew S. Smith
*Assistant Examiner*—William A. Noe
*Attorney, Agent, or Firm*—McGinn & Gibb P.C.

[57] ABSTRACT

A low-cost non-contact type charging device having excellent uniform charging performance and long stable charging characteristic includes an insulating support body having an insulating surface, first electrodes, to which a first voltage is applied, and second electrodes, to which a second voltage is applied. The first electrodes and the second electrodes, isolated from each other, are alternately formed, in non-parallel to a relative moving direction between a charging member and a charged body. Further, the first electrodes and the second electrodes are provided at respective positions in a width in the relative moving direction of the charging member, and moved close to the charged body in a non-contact state.

18 Claims, 4 Drawing Sheets

CHARGING DEVICE FOR CHARGING CHARGED BODY IN NON-CONTACT STATE

BACKGROUND OF THE INVENTION

1. Field of the Invention

This invention relates to a charging device in an image forming apparatus and, more particularly to a charging device which charges a charged body by moving a charging member close to the charged body in non-contact state.

2. Description of the Prior Art

Image forming apparatuses including optical printers such as copiers, laser printers, electrostatic image recording apparatuses and the like, use a photosensitive body, a dielectric body or the like as an image carrier to be charged in image formation. That is, the image carrier such as the photosensitive body or dielectric body is a charged body. As a charging device to charge the charged body, a corona-discharge type charging device using a corona wire is known.

In recent years, a pin-discharge type charging device using a metal plate having a number of sharp edge portions on the charged body side, i.e., so-called saw-tooth electrode plate has been proposed. This charging device performs corona discharge from the end of the sharp edge portions. Japanese Patent Application Laid-Open No. 8-106198 discloses the corona charging device with a saw-tooth electrode.

Further, in recent years, contact-type charging devices such as a brush charging device, a roller charging device or a blade charging device, which charge a charged body by bringing a charging member into contact with the charged body, have been proposed and put into practical use. These contact-type charging devices perform charging by bringing the charging members such as brushes, rollers or blades and a blade, connected to a power source output, into contact with the surface of an image carrier as the charged body.

However, the above-described respective charging devices have the following problems. The corona charging device using the corona wire needs a high-voltage power source having the absolute output value of 4–7 kV and space for providing a shield around the wire. This causes problems when treating the device or performing wiring and setting the size of the device. Further, as corona discharge by a high voltage causes a large amount of corona products such as ozone, it is necessary to take measures to cope with the corona products. Further, the discharge by using a wire causes discharge unevenness in a wire lengthwise direction, thus easily causes charging unevenness. The charging unevenness is also caused by contamination of the wire. The charging unevenness can be improved by a scorotron charging device having a grid electrode between a discharge wire and a discharged body, however, in the scorotron charging device, the wire voltage must be higher, therefore, the occurrence of ozone and the like increases.

As a compact charging device to replace the corona charging device using the corona wire, a pin-discharge type corona charging device using a needle electrode or saw-tooth electrode has been proposed. However, the pin-discharge type charging device still needs a high-voltage power source similar to that of the corona charging device. Further, as discharging portions are arranged at fixed intervals, charging unevenness easily occurs. This charging device cannot be applied to high-density and high-resolution image formation, which must be further improved. When foreign materials are attached to the end portion of the sharp discharging portions or any mechanical defect occurs, charging uniformity is a more serious problem. Similar to the above-described scorotron charging device, a charging device with a grid electrode has been proposed to improve the charging unevenness in the pin-discharge type discharging device, however, it is not effective to obtain charging uniformity.

Japanese Patent Application Laid-Open No. 8-106198 proposes a charging device using a saw-tooth electrode and a grid electrode, where the end of the saw-tooth electrode plate is opposite to the shield so as to obtain a small and uniform charging characteristic. However, in this charging device, a high voltage of −5 kV must be applied to the saw-tooth electrode, which causes a large amount of ozone and the like. Further, even though the size of this device is smaller than that of the wire-discharge type device, the downsizing has not been made on a large scale. Accordingly, an image forming apparatus using this device needs large space, in consideration of measures against corona products.

Japanese Patent Application Laid-Open No. 61-99172 proposes a construction of a scorotron charging device in which the grid electrode is divided in an axial direction of a photosensitive body into several portions to respectively receive an applied potential. The grid portion having a first electrode, an insulating layer and a second electrode controls selective charging with respect to the photosensitive body. However, for the purpose of charging uniformity, the respective layers having an opening pattern must be precisely deposited. Further, if the grid portion has a three layer structure, higher deposition precision is required. This increases the price of the product. Further, wiring must be made on the respective electrodes, which also increases the price. As the size and arrangement of the opening patterns influence the charging uniformity, the opening size and the opening pattern arrangement cannot be optimized without difficulty, and practical patterns cannot be designed without difficulty. Further, in a case where the grid has the second electrode to perform charging/not charging control, as the opening pitch and arrangement of the opening patterns influence the image forming resolution, this structure cannot be applied to high-resolution image formation without difficulty. Further, the device basically usels a corona wire, it has problems regarding its high-voltage power source, device size and corona products, similar to those of the above-described corona charging device.

In recent years, the contact-type charging devices widely used in small laser printers and the like also have problems. In the use of brush charging, it is difficult to realize a stable charging uniformity through manufacture of the brush, attachment of the brush, determination of power application condition and the like. This may cause charging failure, and cannot obtain high reliability. In the use of roller charging, the problems in the charging uniformity and reliability are reduced since manufacture and attachment of the roller are easier in comparison with the case of the brush, however, there are still problems in deterioration of charging performance when the roller surface has a flaw or foreign material is attached to the roller surface and in image formation at a high speed. In the use of blade charging, as the same linear portion is always in contact with a charged body, maintenance of the characteristic of the contact portion is very significant.

This poses problems in reliability, cost, and image formation at a high speed.

Further, it can be generally considered in all the contact-type charging devices that, if there is a defect such as a pin hole on the charged body side, spark discharge occurs and charging failure occurs in the lengthwise direction including the pin hole. Furthermore, when a multi-color image is formed on the image carrier such as a photosensitive body, the contact-type charging disturbs an image formed on the image carrier, and the image cannot be used.

SUMMARY OF THE INVENTION

The present invention has been made in consideration of the above problems, and has its object to provide a small charging device with excellent charging performance, which can be manufactured and attached at a low cost and can be used for forming a multi-color image on an image carrier.

According to one aspect of the present invention, a charging device which charges a charged member includes a charging member, a first voltage supplying circuit and a second volatge supplying circuit. The charging member has first and second electrodes which are isolated from each other and provided alternately. The first and second electrodes are positioned close to the charged member in non-contact state. The first voltage supplying circuit supplies a first voltage to the first electrodes. The second voltage supplying circuit supplies a second voltage to the second electrodes. The first voltage is bigger than the second voltage.

The first electrodes and second electrodes are provided in non-parallel to a relative moving direction of the charging member and the charged member, and provided alternately a plurality of times along a line perpendicular to the relative moving direction.

According to the charging device of the present invention, the first and second electrodes, isolated from each other and alternately arranged a plurality of times on the surface where the charging member is opposite to the charged member in a non-contact state, are provided a non-parallel arrangement to the relative moving direction. Accordingly, the charged member is charged by two steps of charging, i.e., charging by the first electrodes that receive the first voltage, and charging by the second electrodes that receive the second voltage, with respect to the respective parts of the charged member.

Further, in the charging device of the present invention, the first and second electrodes, isolated from each other and alternately arranged a plurality of times on the surface where the charging member is opposite to the charged member a non-contact state, are provided a non-parallel arrangement to the relative moving direction between the charging member and the charged member. The distance between the second electrodes and the charged member is less than the distance between the first electrodes and the charged member. Accordingly, the charged member is charged to a voltage closer to the second voltage, by two steps of charging, i.e., by the first electrode that received the first voltage, and charging by the second electrode that received the second voltage, with respect to the respective parts of the charged member.

Further, in the charging device of the present invention, since the first voltage applied to the first electrodes and the second voltage applied to the second electrodes are different from each other, the charging characteristics by the first and second electrodes can be respectively variably controlled.

Further, in the charging device of the present invention, since at least the surface of the first electrode on the charged member side is not smooth, discharge is more effectively performed for discharge from the first electrode to the charged member.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
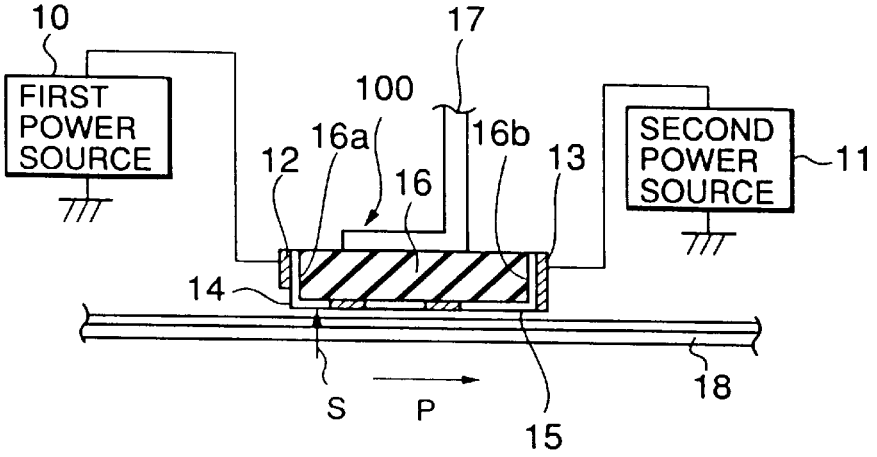
FIG. 1 is a schematic cross-sectional view showing a charging device according to a first embodiment of the present invention.
Figure 2:
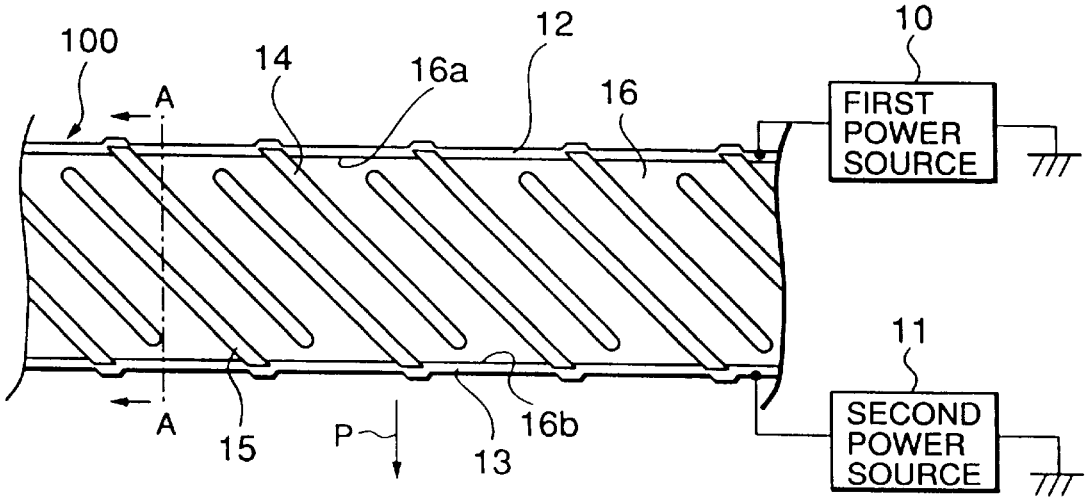
FIG. 2 is a partially elevational view electrode showing a charging member in FIG. 1, viewed from the side of a charged body.

FIG. 1 shows a charging device according to a first embodiment of the present invention, and FIG. 2 shows a charging member 100 in FIG. 1, viewed from an arrow S, that is, from the side of a charged body (photosensitive body 18). In FIG. 1 and FIG. 2, the charging device has the charging member 100, a first power source 10 and a second power source 11. The charging member 100 in FIG. 1 shows a cross sectional view taken along lines A—A of FIG. 2.

The charging member 100 has an insulating support body 16, first electrodes 14, second electrodes 15, a first common electrode 12 and a second common electrode 13. In the charging member 100, the first and second electrodes 14 and 15 are provided on the surface of the insulating support body 16 facing to the photosensitive body 18, and the charging member 100 is provided close to the photosensitive body 18, in non-contact status. The first electrodes 14 receive output from the first power source 10 through the first common electrode 12, and the second electrodes 15 receive output from the second power source 11 through the second common electrode 13.

The insulating support body 16 is a member formed with resin or the like. The charged body 18 moves in a relative moving direction as shown by an arrow P. The first electrodes 14 and the second electrodes 15 are formed with respect to a surface of the insulating support body 16 on the charged body side. The first electrodes 14 are further formed on a first side surface 16*a* of the insulating support body 16 of an upstream side with respect to the relative moving direction P, and the second electrodes are further formed on a second side surface 16*b* of a downstream side.

As shown in FIG. 2, the first electrodes 14 and the second electrodes 15 are provided in the relative moving direction P within the width of the charging member, in a non-parallel arrangement with respect to the relative moving direction P. Each of the electrodes is provided at an angle of about 45° with respect to the relative moving direction P. The first electrodes 14 and the second electrodes 15 are alternately provided a plurality of times sequentially along a line perpendicular to the relative moving direction P.

One end of each of the respective first electrodes 14 is located on the surface facing to the photosensitive body 18, not formed on the second side surface 13. One end of each of the respective second electrodes 15 is located on the surface facing to the photosensitive body 18, not formed on the first side surface 16*a*. The respective first electrodes 14 are electrically interconnected via the first common electrode 12 on the first side surface 16*a*. The respective second electrodes 15 are electrically interconnected via the second common electrode 13 on the second side surface 16*b*. As shown in FIG. 1, the second common electrode 13 is formed on the second side surface 16*b* from an upper end of the insulative support member 16 to a lower end facing to the photosensitive body 18.

As the first electrode 14, an electrode member coated with conductive polymer including metal filler, carbon or ion conductive material, or a film or thin layer plate member formed with similar conductive polymer, is attached to the surface of the insulating support body. The electric resistance of the electrode is set within a range of 10 to $10^{15}$ Ωcm, or preferably within a range of $10^{5}$ to $10^{10}$ Ωcm in consideration of charging characteristic, the power source capacitance and the like.

As the second electrode 15, an electrode member coated with conductive polymer or a film or thin layer plate material, similar to the first electrode 14, or further, a metal-plated or coated member is employed. The electric resistance of the electrode is at the same level or lower than that of the first electrode 14, since charging by the second electrode 15 is mainly made to stabilize the charged potential.

Low-resistance conductive wiring by metal plating, coating or the like, is made on the first common electrode 12 and the second common electrode 13, so as not to cause application voltage difference between the first electrodes 14 or between the second electrodes 15 due to wiring distances from the respective power sources.

The respective first electrodes 14 are connected via the first common electrode 12 to the first power source 10 which outputs a first voltage, and receive the applied first voltage, while the respective second electrodes 15 are connected via the second common electrode 13 to the second power source 11 which outputs the second voltage, and receive the applied second voltage. The absolute value of the first voltage applied to the first electrodes 14 is 1 to 4 kV, in case of direct current, while the absolute value of the second voltage applied to the second electrodes 15 is 500 V to 2 kV. The second voltage has a desired voltage value for charging the charged body 18 to a target charged potential 450 V to 1.8 kV, and the first voltage has a voltage value bigger than the second voltage by 1.4 to 2.0 times. In the charging member 100 having this construction, the insulating support body 16 supported by a holding member 17 is provided such that the distances between the surface of the photosensitive body 18, and the first electrode 14 and the second electrode 15 are about 0.1 to 2 mm.

Next, the operation of the first embodiment will be described. The photosensitive body 18, destaticized and moved to a position below the charging member 100, is charged by the first electrodes 14 to which the first voltage 1 to 4 kV has been applied, by micro-corona discharge from the surfaces of the first electrodes 14.

However, the entire surface of the photosensitive body 18 is not charged to a target charged potential 450 V to 1.8 kV, always in a stable manner, due to change of the characteristic of the photosensitive body and environmental variation. The photosensitive body 18 charged by the first electrodes 14 is moved while it is charged by both the second electrodes 15 and the second common electrode 13 to which the second voltage 2 has been applied. The second charging unifies the uneven charged state caused by the first electrodes 14, and thus charges the entire surface of the photosensitive body 18 to the target charged potential.

In the charging member, in the width in the relative moving direction between the charging member 100 and the photosensitive body 18, at least the first electrodes 14 and the second electrodes 15 are sequentially provided, on respective lines in the relative moving direction P, in a non-parallel configuration, inclined to the relative moving direction P. The first and second electrodes are alternately provided a plurality of times in a lengthwise direction of the charging member, orthogonal to the relative moving direction P, i.e., a widthwise direction of the photosensitive body 18. This arrangement prevents charging unevenness. This two-step charging is performed on the respective parts of the charged body, and thus attains uniform and stable charging even when the distance between the charging member and the photosensitive body has changed.

Further, as the charging member 100 and the charged body 18 are provided in non-contact state, foreign material such as dirt is not attached to the charging member. Further, the charged body does not have a flaw on its surface. This provides a charging device with a high operation reliability. Further, even if the charged body side has a defect or the like, the non-contact arrangement of these members avoids stripe-shaped charging unevenness.

Further, as the charging is made by the charging member 100 close to the charged body 18, it is unnecessary to apply high voltages to the first and the second electrodes 14 and 15 which causes ozone and the like. This is advantageous from an environmental view. As the charging member 100 is constructed by simply sequentially arranging the first electrodes 14 and the second electrodes 15, having basically the same structure, on the insulating support body 16, the charging member 100 is easily manufactured at a low cost. Further, the charging member 100 can be easily used for different charged bodies, different target charged potentials and the like, by changing the first voltage and the second voltage.

Figure 3A:
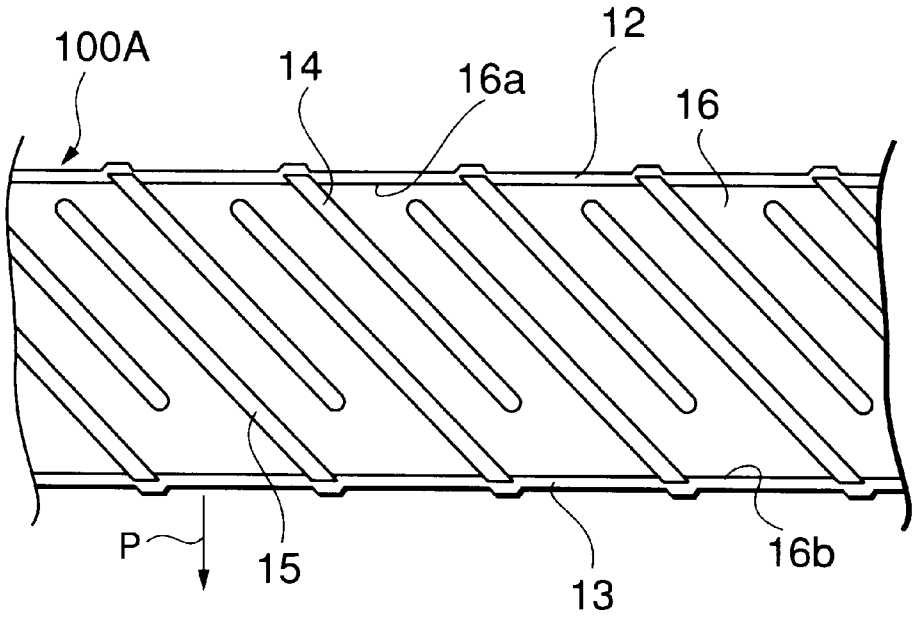
FIG. 3A and FIG. 3B are partially elevational views showing another charging member in FIG. 1, viewed from the side of the charged body.

In FIG. 3A, another charging member 100A is shown. First ends of the first electrodes 14 do not protrude from the position at which the ends of the second electrodes 15 on the side of the second side surface 16*b* are located. In this case, it is unnecessary for the second common electrode 13 to cause the photosensitive body 18 to be charged; that is, only the first and the second electrodes 14 and 15 contributes to the charging operation.

Figure 3B:
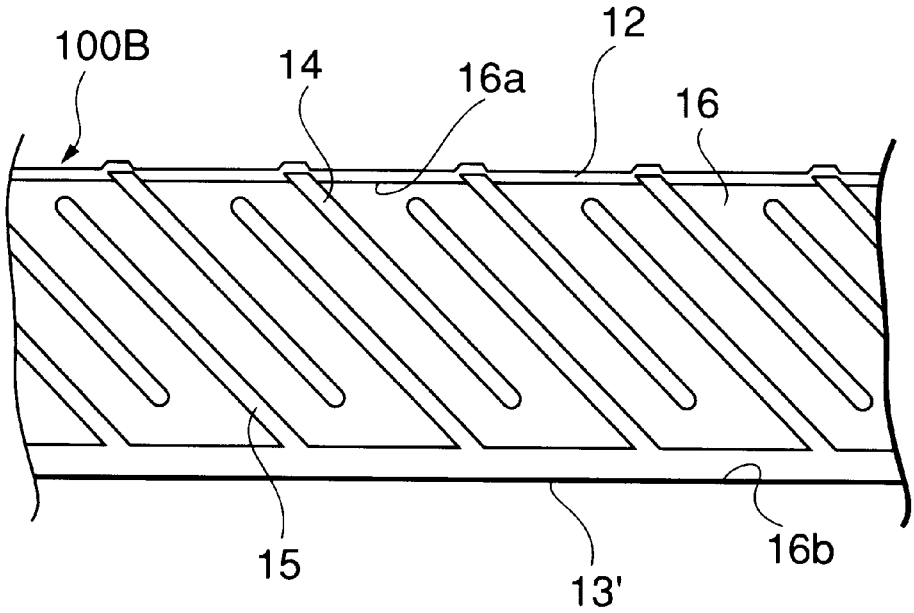

In FIG. 3B, a charging member 100B is shown. The second common electrode 13' connected to the second electrodes 15 is formed on the surface facing to the photosensitive body 18 instead of on the side surface 16*b*.

The charging members 100, 100A and 100B have the structures that the second electrodes 15 or the second common electrodes 13 and 13' are located in the relative moving direction with respect to the first electrodes 14. This is important for charging the photosensistive body 18 to the target charged potential.

Figure 4:
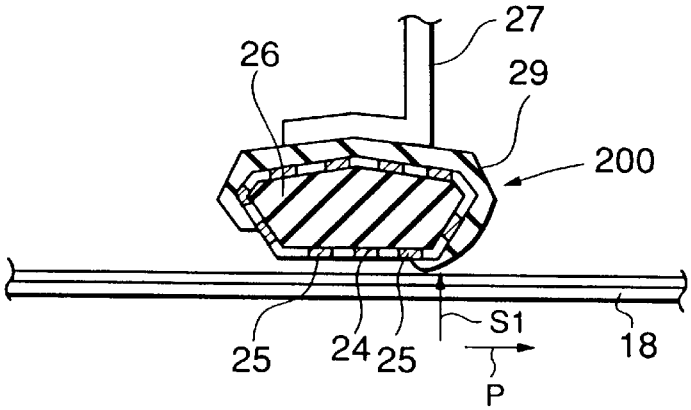
FIG. 4 is a schematic cross-sectional view showing the charging device according to a second embodiment of the present invention.
Figure 5:
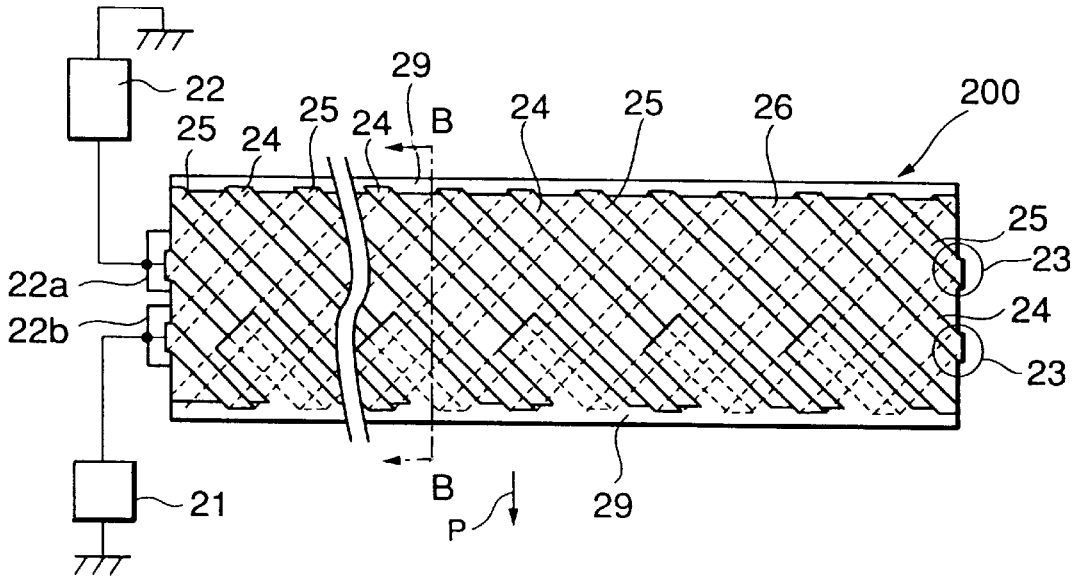
FIG. 5 is an electrode arrangement diagram showing the charging member in FIG. 4, viewed from the side of the charged body.

FIG. 4 is a schematic cross-sectional view showing the charging device according to a second embodiment of the present invention. FIG. 5 is an electrode arrangement diagram showing the charging member in FIG. 4, viewed from an arrow S1, from the side of the charged body. The charging member 200 in FIG. 4 shows a cross sectional view taken along lines B—B of FIG. 5.

In FIG. 4 and FIG. 5, the charging member 200, having first and second electrodes 24 and 25 coiled around an insulating support body 26, is held by a holding member 27 via an insulating coating material 29, and provided close to a photosensitive body 28 as the charged body in non-contact state.

As it is apparent from FIG. 5, in the charging member, the first electrodes 24 and the second electrodes 25 are coiled around the insulating support body 26 of resin or the like, at even intervals, at an angle with respect to the lengthwise direction of the insulating support body 26.

On the surface facing to the photosensitive body 18, the insulating coating material 29 covers parts of the second electrodes 25 from the downstream side of the charging member. First and second connection terminals 22*a* and 22*b* to apply output from a first power source 22 and output from a second power source 21 to the first electrodes 24 and the second electrodes 25 are provided on one end surface of the insulating support body 26 in the lengthwise direction.

On the opposite end surface of the charging member 200, a connection portion 23 connecting the same coiled electrodes is provided. The connection portion 23 enables voltage application to the respective first electrodes 24 and the second electrodes 25 only from the one end surface of the insulating support body 26 in the lengthwise direction.

The insulating support body 26, around which the first electrodes 24 and the second electrodes 25 are coiled, is coated with the insulating coating material 29 of resin or the like on the surface connected to the holding member 27, and the holding member 27 is fixed on the insulating support body 26 on this surface via the insulating coating material 29.

As the first electrodes 24 and second electrodes 25, a thin layer ribbon-shaped electrode member of conductive polymer including conductive particles or ion conductive material is employed. In fabrication one of the electrode member and the insulating support body 26 is rotated relatively to the other, and the electrode member is fixed onto the insulating support body 26 by adhesive or heat attachment.

The electric resistance of the first electrodes 24 and that of the second electrodes 25, the first voltage from the first power source 20, and the second voltage from the second power source 21 are the same as those of the first embodiment shown in FIG. 1 to FIG. 3. Further, the distances between the photosensitive body 28, and the first electrodes 24 and the second electrodes 25 are the same as those of the first embodiment. The operation of the second embodiment is the same as that of the first embodiment.

In the present embodiment, as the first electrodes 24 and the second electrodes 25 are coiled around the insulating support body 26 at the same interval at an angle with respect to the lengthwise direction of the insulating support body 26, a charging member of an arbitrary length can be easily manufactured. As the voltage application to the first electrodes 24 and the second electrodes 25 is easily made on one end surface, the charging device can be manufactured at a very low cost.

Further unification of charging characteristic in the lengthwise direction is realized by performing voltage application to the first electrodes 24 and the second electrodes 25 from the other end surface as well as the above end surface, further, connecting corresponding power source outputs to all the respective electrodes exposed on the respective end surfaces. If the insulating coating material 29 has an attaching characteristic, it has insulating and attaching functions, which reduces the cost.

Figure 6:
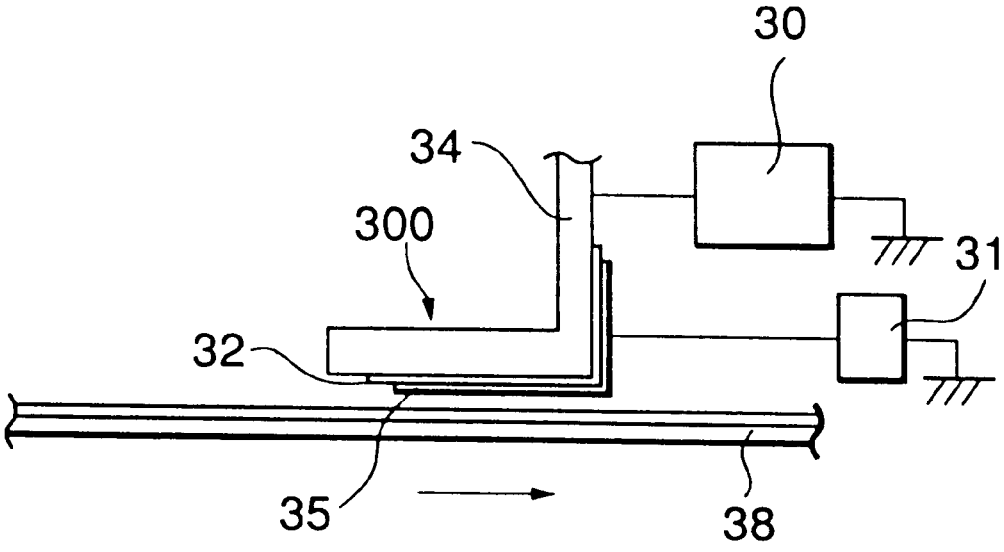
FIG. 6 is a schematic cross-sectional view showing the charging device according to a third embodiment of the present invention.
Figure 7:
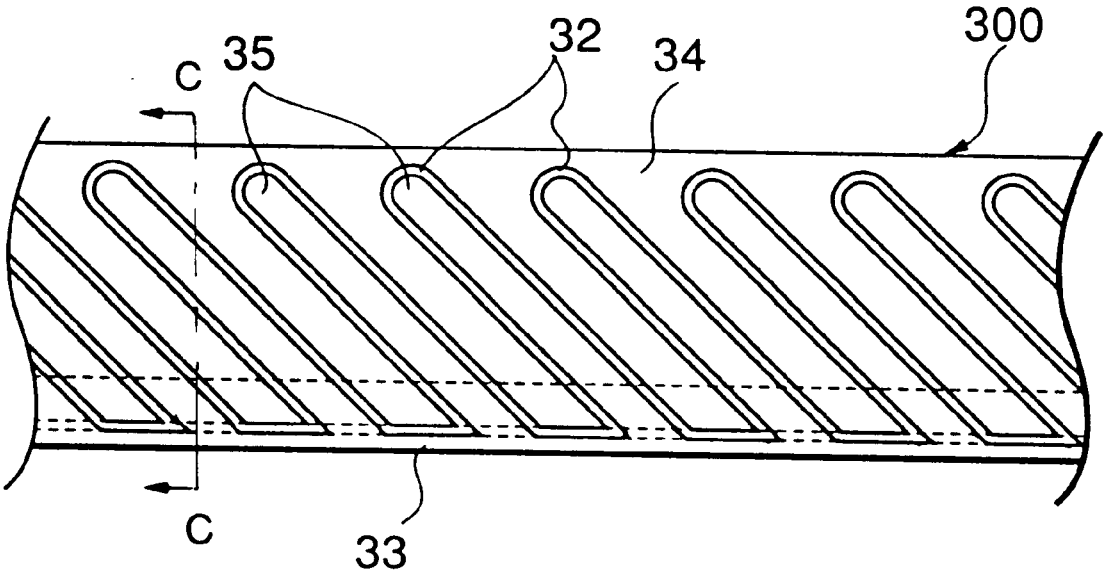
FIG. 7 is an electrode arrangement diagram showing the charging member in FIG. 6, viewed from the side of the charged body.

FIG. 6 is a schematic cross-sectional view showing the charging device according to a third embodiment of the present invention. FIG. 7 is an electrode arrangement diagram showing the charging device in FIG. 6, viewed from the side of the charged body. The charging member 300 in FIG. 6 shows a cross-sectional view taken along lines C—C of FIG. 7. In FIG. 6, the charging member 300 has a first electrode 34, which is used as the support member, having insulating layers 32 and second electrodes 35 deposited on a surface opposite to a photosensitive body 38 as the charged body, provided close to the photosensitive body 38 in non-contact state. The first electrode 34 as the support member receives output from a first power source 30. The second electrodes 35 receive output from a second power source 31.

FIG. 7 shows the shape of the insulating layers 32 and the second electrodes 35 formed on the first electrode 34. The insulating layers 32 and the second electrodes 35 are formed at a non-parallel angle with respect to the relative moving direction between the charging member 300 and the photosensitive body 38. The second electrodes 35 are isolated from the first electrode 34 in the deposition direction. The second electrodes 35 are formed on the insulating layers 32 within a width narrower than that of the insulating layers 32, and are also isolated from the first electrode 34 around them. The second electrodes 35 are arranged in the lengthwise direction of the charging member. As the first electrode 34, a metal material with a rough surface processed by sand blasting or the like, otherwise a resin member of conductive polymer as described in the first embodiment or a metal member coated with conductive polymer and processed to have a rough surface, is employed.

The second electrodes 35 are formed by plating or coating the insulating layers 32 with metal or coating the insulating layers 32 with conductive polymer thin layers. The respective second electrodes 35 are interconnected in the lengthwise direction of the charging member on one side in a supporting direction of the first electrode 34 as the support member. Low-resistance conductive wiring is performed on a common electrode 33 interconnecting the second electrodes 34. The charging member is provided such that the distances between the second electrodes 35 and the charged body is 0.1 to 1 mm.

Next, the operation of the charging device constructed as above and provided close to the charged body in non-contact state will be described. The photosensitive body 38, destaticized and moved to a position below the charging device, is charged by the first electrode 34 to which the first voltage has been applied, by micro-discharge from its rough surface. As the electrode surface is processed to be rough, the discharge is made from the tip portions of the respective projections of the rough surface to the charged body. As the first electrode 34 is provided with a distance from the charged body greater than the distance between the second electrodes 35 and the charged body, the discharge from the first eletrode 34 is expanded wider than the width of the first electrode 34, thus supplying a charge to a wider area. However, as the first electrode 34 is provided in the lengthwise direction of the charging member, and the characteristic of the photosensitive body 38 and the peripheral environment change, uniform charging is not made only by the charging by the first electrode 34.

The photosensitive body 38 as the charged body, charged by the first electrode 34, is moved while it is charged by the second electrodes 35. As the second electrodes 35 are provided at positions closer to the photosensitive body 38 in comparison with the first electrode 34, the charging by the second electrodes 35 corrects the charging unevenness by the first electrode 34 to a uniform charged potential. The uniform charged potential is formed over the entire the charged body by applying a voltage close to a target charged potential to the second electrodes 35 in advance. In this arrangement, the respective charges move from an overcharged portion by the first electrode 34 to the side of the second electrodes 35, and from the side of the second electrodes 35 to an undercharged portion.

In the charging member, since at least the first electrode 34 and the second electrodes 35 are provided on respectively in the relative moving direction between the charging member and the photosensitive body 38 in the width in the relative moving direction, charging unevenness does not occur, as described in the previous embodiments.

As the first electrode 34 is provided with a distance from the charged body greater than the distance between the second electrodes 35 and the charged body, the charging by the first electrode 34 has a greater width, which reduces charging unevenness in the lengthwise direction of the charging member by the first electrode 34, easily caused by the existence of the insulating layers 32 and the second electrodes 35. Further, such a feature allows the second electrodes 35 to easily charge the charged body to unify the charging.

Further, as the charging member has a simple structure where the insulating layers 32 and the second electrodes 35 are deposited on the first electrode 34, the charging member can be simply manufactured at a low cost. It is possible to obtain uniform and stable various charging levels by changing the first voltage and the second voltage.

As described above, the embodiments of the present invention have been explained, however, the present invention is not limited to these embodiments and various changes can be made within the scope of invention. For example, in the third embodiment, the insulating layers and the second electrodes may be coiled around the first electrode, and the charging member, may be operated with respect to the charged body, while rotated at different speeds, as arranged in the second embodiment. In this case, the first voltage and the second voltage are applied from both ends in the lengthwise direction of the charging member.

In the embodiments, the first voltage and the second voltage are direct current voltages. However, for more uniform charging and further improvement of applicability from an environmental view, the direct currents may be effectively overlaid with alternating currents. Further, the charging member may be constructed by sequentially depositing plate first electrodes and second electrodes via plate insulating members, and providing common electrodes for the respective first and second electrodes on the both end surfaces parallel to the lengthwise direction, as arranged in the first embodiment. The charged body is not limited to the photosensitive body. A cylindrical charged body may be employed. Further, the side of the charging member opposite to the charged body may have a shape corresponding to the charged body.

Further, in the charging device, the first voltage and the second voltage are direct current voltages or voltages obtained by overlaying direct currents with alternating currents.

As described above, in the charging device of the present invention, as the first electrodes and the second electrodes, isolated from each other, are provided a plurality of times in a non-parallel configuration to the relative moving direction between the charging member and the charged body, the charged body can be charged to a predetermined charged level by two steps of charging, i.e., charging by the first electrodes that received the first voltage, and charging by the second electrodes that received the second voltage.

Further, as the entire surface of the charged body is charged by the two steps of charging, charging unevenness can be prevented.

Further, as the charging member and the charged body are provided in non-contact state, the charged body does not have a flaw, and foreign material is not attached or accumulated on the charging member. This obtains stable operation and high reliability.

Further, even when a defect such as a pin hole occurs in the charged body, stripe-shaped charging failure does not occur. The voltages applied to the respective electrodes are not high voltages as those used in the conventional corona-discharge type charging device, which reduces production of ozone and the like, which is advantageous from an environmental view. As the charging member has a simple structure where the first electrodes and the second electrodes are sequentially provided, the charging member can be easily manufactured at a low cost. As the charging device has a high reliability, it is advantageous in running cost.

Further, in the charging device of the present invention, as the distance between the first electrode and the charged body is greater than the distance between the second electrodes and the charged body, the charging by the first electrode that received the first voltage is wider than the width of the first electrode, to charge a wider area of the charged body. Further, as the second electrodes are closer to the charged body, the charged body is uniformly charged by the second electrodes that received the second voltage having a charging potential close to the target charged potential. Further, as the charging member can be constructed only by sequentially depositing the first electrode, the insulating layers and the second electrodes, the charging member can be manufactured at a low cost.

Further, in the charging device of the present invention, as the respective parts of the surface of the charged body are to be opposite to the first electrodes and the second electrodes by the relative motion between the charging member and the charged body, the surface of the charged body is charged by two steps of charging without unevenness, to a predetermined charged level.

Further, in the charging device of the present invention, the respective voltages can be variably controlled and the charging characteristics can be variably controlled, in correspondence with various charging requirements.

Further, in the charging device of the present invention, as the discharging characteristic can be improved, the charged body can be charged at a lower voltage, which reduces occurrence of ozone and the like.

As many apparently widely different embodiments of the present invention can be made without departing from the spirit and scope thereof, it is to be understood that the invention is not limited to the specific embodiments thereof except as defined in the appended claims.

What is claimed is:

1. A charging device which charges a charged member, comprising:

a charging member including first electrodes and second electrodes which are isolated from each other and provided alternately, said first and second electrodes being positioned close to said charged member in non-contact state;

a first voltage supplying means for supplying a first voltage to said first electrodes; and a second voltage supplying means for supplying a second voltage to said second electrodes, said first voltage being larger than said second voltage.

2. The charging device according to claim 1, wherein said first electrodes and second electrodes are provided non-parallel to a relative moving direction of said charging member and said charged member, and are provided alternately a plurality of times along a line perpendicular to said relative moving direction.

3. The charging device according to claim 2, wherein the charging device further comprises a first common electrode connected between said first electrodes and said first voltage supplying means, and a second common electrode connected between said second electrodes and said second voltage supplying means.

4. The charging device according to claim 3, wherein said second common electrode is located downstream of said first common electrode in said relative moving direction and said first common electrode is located upstream of said second common electrode in said relative moving direction.

5. The charging device according to claim 4, wherein said charging member further comprises an insulating body on which said first and second electrodes are formed.

6. The charging device according to claim 2, wherein said second electrodes are located downstream in said relative moving direction with respect to said first electrodes.

7. The charging device according to claim 6, wherein said charging member further comprises an insulating body on which said first and second electrodes are formed.

8. The charging device according to claim 7, wherein first ends of said first electrodes are located on a surface facing said charged member, and first ends of said second electrodes are located on said surface facing said charged member.

9. The charging device according to claim 2, wherein said charging member further comprises an insulating body on which said first and second electrodes are coiled alternately.

10. The charging device according to claim 9, further comprising an insulating coated member which is coated on parts of said second electrodes.

11. The charging device according to claim 6, wherein a distance between said second electrodes and said charged member is shorter than that between said first electrodes and said charged member.

12. The charging device according to claim 1, wherein said first voltage and said second voltage are direct current voltages or voltages obtained by overlaying direct currents with alternating currents.

13. The charging device according to claim 1, wherein said second voltage has a voltage value approximately that of a target charged potential of said charged member.

14. The charging device according to claim 13, wherein said first voltage is higher than said second voltage by 1.4 to 2.0 times.

15. A device for charging a workpiece, comprising:

a charging member including first electrodes and second electrodes provided alternately along a line perpendicular to a relative moving direction of said charging member and said workpiece, and positioned adjacent said workpiece in a non-contact state; and a voltage supply for supplying a first voltage to said first electrodes, and for supplying a second voltage to said second electrodes, said first and second voltages having different values.

16. The device according to claim 15, wherein said voltage supply comprises a first voltage supply member for supplying said first voltage and a second voltage supply member for supplying said second voltage.

17. The device according to claim 15, wherein said first electrodes and second electrodes are isolated from one another.

18. The device according to claim 16, wherein the first voltage is larger than said second voltage, said device further comprising:

a first common electrode connected between said first electrodes and said first voltage supply member, and a second common electrode connected between said second electrodes and said second voltage supply member.

* * * * *